US010259241B2

(12) United States Patent
Miller et al.

(10) Patent No.: US 10,259,241 B2
(45) **Date of Patent: *Apr. 16, 2019**

(54) VACUUM CYLINDER WITH RECESSED PORTIONS FOR HOLDING ARTICLES FOR PRINTING

(71) Applicant: NIKE, Inc., Beaverton, OR (US)

(72) Inventors: Todd W. Miller, Portland, OR (US); Catherine F. Morrison, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 63 days.

This patent is subject to a terminal disclaimer.

(21) Appl. No.: 15/198,388

(22) Filed: Jun. 30, 2016

(65) Prior Publication Data

US 2016/0303876 A1 Oct. 20, 2016

Related U.S. Application Data

(63) Continuation of application No. 14/242,713, filed on Apr. 1, 2014, now Pat. No. 9,409,414.
(Continued)

(51) Int. Cl.
*B41J 3/407* (2006.01)
*B41J 13/22* (2006.01)
(Continued)

(52) U.S. Cl.
CPC ..... *B41J 13/226* (2013.01); *B41J 3/4073* (2013.01); *B41J 3/4078* (2013.01); *B41J 11/04* (2013.01); *B41M 5/0088* (2013.01)

(58) Field of Classification Search
CPC ..... B41J 13/226; B41J 11/04; B41J 3/4078; B41J 3/4073; B41M 5/0088
See application file for complete search history.

(56) References Cited

U.S. PATENT DOCUMENTS 701,841 A 6/1902 Daniel
1,830,638 A 11/1931 Butz
(Continued)

FOREIGN PATENT DOCUMENTS

CN 1088159 A 6/1994
CN 2390749 Y 8/2000
(Continued)

OTHER PUBLICATIONS

Office Action, dated Aug. 17, 2017, for corresponding Chinese Patent Application No. 201480019118.7, 8 pages. No English-language translation provided.
(Continued)

*Primary Examiner* — Huan H Tran
(74) *Attorney, Agent, or Firm* — Klarquist Sparkman, LLP

(57) ABSTRACT

A customization system for an article of equipment includes a printing system for printing a graphic onto the article. The customization system also includes a cylinder for holding the article for printing a graphic upon the article. The cylinder can include one or more recesses in the outer surface of the cylinder to accommodate the article. A partial vacuum applied to the article when disposed within the recess through ports in the bottom surface of the recess holds the article in place within the recess while the cylinder rotates during printing. A gasket can be included between the recess in the cylinder and the article to provide an airtight seal to hold the article in place.

13 Claims, 8 Drawing Sheets

Related U.S. Application Data

(60) Provisional application No. 61/808,569, filed on Apr. 4, 2013.

(51) Int. Cl.
*B41J 11/04* (2006.01)
*B41M 5/00* (2006.01)

(56) References Cited

U.S. PATENT DOCUMENTS

| | | | | |
|---|---|---|---|---|
| 2,249,939 | A | 7/1941 | Branan | |
| 2,459,538 | A | 1/1949 | Robbins | |
| 2,920,556 | A | 1/1960 | Medert et al. | |
| 2,974,838 | A | 3/1961 | Parham | |
| 3,794,314 | A | 2/1974 | Coburn et al. | |
| 4,303,459 | A | 12/1981 | Kleber | |
| 4,561,642 | A | 12/1985 | Parque | |
| 4,590,854 | A | 5/1986 | Anderson | |
| 4,619,384 | A | 10/1986 | Chu et al. | |
| 4,846,483 | A | 7/1989 | Sorensen | |
| 4,930,413 | A | 6/1990 | Jaffa | |
| 5,288,322 | A | 2/1994 | Hanna et al. | |
| 5,831,641 | A | 11/1998 | Carlson | |
| 5,878,658 | A | 3/1999 | Ackley | |
| 5,906,363 | A | 5/1999 | Reis et al. | |
| 6,014,162 | A | 1/2000 | Kerr et al. | |
| 6,254,081 | B1 | 7/2001 | Rasmussen et al. | |
| 6,267,054 | B1 | 7/2001 | Lopes | |
| 6,481,347 | B2 | 11/2002 | Ackley | |
| 6,729,235 | B2 | 5/2004 | Kerr | |
| 7,114,445 | B2 | 10/2006 | Ackley et al. | |
| 7,311,045 | B2 | 12/2007 | Ackley et al. | |
| 7,946,668 | B2 | 5/2011 | Baker et al. | |
| 9,321,257 | B2 | 4/2016 | Miller et al. | |
| 2001/0042455 | A1 | 11/2001 | Ackley | |
| 2008/0229943 | A1 | 9/2008 | Barinaga et al. | |
| 2011/0036252 | A1 | 2/2011 | Middo et al. | |
| 2011/0232514 | A1 | 9/2011 | Putzer et al. | |
| 2013/0057632 | A1 | 3/2013 | Moriya et al. | |
| 2013/0337128 | A1 | 12/2013 | Van et al. | |
| 2013/0340484 | A1 | 12/2013 | Turner | |
| 2014/0299009 | A1* | 10/2014 | Miller | B41F 17/005 101/36 |
| 2014/0300676 | A1 | 10/2014 | Miller et al. | |

FOREIGN PATENT DOCUMENTS

| | | | |
|---|---|---|---|
| CN | 201703004 | U | 1/2011 |
| CN | 105073432 | A | 11/2015 |
| CN | 105121170 | A | 12/2015 |
| EP | 2941352 | A1 | 11/2015 |
| EP | 2941353 | A1 | 11/2015 |
| GB | 736650 | A | 9/1955 |
| GB | 2291011 | A | 1/1996 |
| JP | 07-081050 | | 3/1995 |
| JP | Hei 10-175136 | | 6/1998 |
| JP | 2001-270096 | | 10/2001 |
| JP | 2005-053138 | | 3/2005 |
| KR | 10-2012-0053418 | | 5/2012 |
| KR | 10-1168660 | | 7/2012 |
| WO | WO 01/50877 | | 7/2001 |
| WO | WO 2012/165757 | | 12/2012 |

OTHER PUBLICATIONS

Office Action, dated Oct. 20, 2017, for corresponding Korean Patent Application No. 10-2015-7030201, 6 pages, with English-language translation.
European Communication pursuant to Rules 161(1) and 162 EPC for European Patent Application No. 14729117.3, dated Sep. 2, 2015.
European Communication pursuant to Rules 161(1) and 162 EPC for European Patent Application No. 14732990.8, dated Sep. 3, 2015.
International Preliminary Report on Patentability and Written Opinion for Application No. PCT/US2014/032677, dated Oct. 15, 2015.
International Preliminary Report on Patentability and Written Opinion for Application No. PCT/US2014/032798, dated Oct. 6, 2015.
International Search Report dated Sep. 1, 2014 in PCT/US2014/032798.
International Search Report for Application No. PCT/US2014/032677, dated Sep. 1, 2014.
Non-Final Office Action dated Jun. 30, 2016 in U.S. Appl. No. 15/059,829.
Response to Non-Final Office Action filed Aug. 1, 2016 in U.S. Appl. No. 15/059,829.
Response to European Communication pursuant to Rules 161 {1) and 162 EPC for European Patent Application No. 14732990.8 as filed Feb. 5, 2016.
Response to European Communication pursuant to Rules 161 {1) and 162 EPC for European Patent Application No. 14729117.3 as filed Feb. 9, 2016.
Office Action dated Mar. 8, 2016 in CN 201480019118.7.
Notice of Acceptance dated Nov. 27, 2015 in VN 1-2015-04172.
Notice of Acceptance dated Nov. 27, 2015 in VN 1-2015-04224.
Office Action dated Jun. 2, 2016 in CN 201480018880.3.
Office Action and Search Report dated Jun. 1, 2016 for CN Application No. 201480018880.3.
Response to Office Action filed Jul. 22, 2016 in CN 2014800191187.
Office Action, dated Sep. 19, 2017, for corresponding European Patent Application No. 14732990.8, 5 pages.
Office Action dated Jun. 1, 2016 in CN 201480018880.3.
Notice of Allowance dated Aug. 31, 2016 for U.S. Appl. No. 15/059,829.
Response to the First Office Action filed on Jul. 22, 2016, for Chinese Application No. 201480019118.7.
Preliminary Amendments filed Aug. 18, 2016 in JP2016-506606.
Office Action with English-language translation, dated Apr. 12, 2017, for corresponding Korean Patent Application No. 10-2015-7030201, 14 pages.
Office Action with English-language translation, dated Jun. 1, 2017, for corresponding Japanese Patent Application No. 2016-506606, 8 pages.

* cited by examiner

VACUUM CYLINDER WITH RECESSED PORTIONS FOR HOLDING ARTICLES FOR PRINTING

CROSS-REFERENCE TO RELATED APPLICATION

This application is a continuation of U.S. Pat. No. 9,409,414, currently U.S. application Ser. No. 14/242,713, titled "Vacuum Cylinder with Recessed Portions for Holding Articles for Printing", filed on Apr. 1, 2014 and allowed on Apr. 5, 2016, which application claims priority under 35 U.S.C. § 119(e) to U.S. Provisional Patent Application No. 61/808,569, entitled "Vacuum Cylinder with Recessed Portions for Holding Articles for Printing", and filed on Apr. 4, 2013, which applications are both hereby incorporated by reference.

BACKGROUND

The present invention relates generally to articles that are to be worn and in particular to a customization system for printing onto articles to be worn.

Systems for printing onto three dimensional articles are known in the art. U.S. Pat. No. 5,831,641 to Carlson discloses methods and an apparatus for imprinting indicia on a three dimensional article using an ink jet image transfer technique. Carlson uses an article positioning apparatus that maintains the surface of the three dimensional article to be printed within a plane substantially parallel and spaced apart from the plane of the ink jet nozzles. Carlson discloses printing onto a baseball bat, which is typically a rigid article having a relatively uniform smooth surface for printing.

Therefore, there exists a need in the art for an apparatus for holding other types articles, including articles that are to be worn, for printing.

SUMMARY

A printing system includes a printer, a cylinder, and a vacuum system. The cylinder is configured to hold articles to be printed upon, so the cylinder is positioned proximate the printer. The cylinder is in fluid communication with the vacuum system. The cylinder includes holes so that when the vacuum system is operating, a partial vacuum is drawn in the vicinity of the holes. This partial vacuum holds the article in position on the surface of the cylinder for printing. The holes are generally positioned within a recess, the size and shape of which is configured to accommodate the article. An optional gasket is disposed around at least a perimeter of the recess, and may partially or entirely cover the recess. The gasket may seal the edges of the article against the cylinder surface when the vacuum in drawn so that the article is securely held in place during the printing process. The printing process may entail translation and/or rotation of the cylinder so that the entire article may be positioned for printing.

In one aspect, the invention provides a customization system for printing a graphic onto an article of equipment, comprising: a printing system, including a printer; a cylinder for holding the article in proximity to the printer; a vacuum system in fluid communication with the cylinder; wherein the article is disposed within a recess in an outer surface of the cylinder; and wherein the vacuum system is configured to apply a partial vacuum to the article to hold the article within the recess.

In another aspect, the invention provides a cylinder for holding an article of equipment to assist with printing a graphic onto the article, comprising: an outer surface of the cylinder, the outer surface having a length along a longitudinal direction of the cylinder and the cylinder having a diameter; a recess disposed in the outer surface of the cylinder, the recess sized and dimensioned so as to correspond to the article of equipment; a fluid line for receiving a partial vacuum; a plurality of ports disposed along a bottom surface of the recess; wherein the fluid line and the plurality of ports are in fluid communication; and wherein the cylinder is configured to rotate to expose an exterior surface of the article to a printer for printing.

In another aspect, the invention provides a cylinder for holding an article of equipment to assist with printing a graphic onto the article, comprising: a diameter associated with the cylinder and a length along a longitudinal direction of the cylinder; an outer surface disposed over the length of the cylinder; the outer surface including at least one recess, the at least one recess extending to a bottom surface at a depth below the outer surface; the bottom surface of the at least one recess including a plurality of ports, the plurality of ports being in fluid communication with an interior of the cylinder; wherein the article is configured to be disposed within the at least one recess in the outer surface of the cylinder; and wherein a partial vacuum applied to the article through the plurality of ports is configured to hold the article within the recess while the cylinder rotates.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
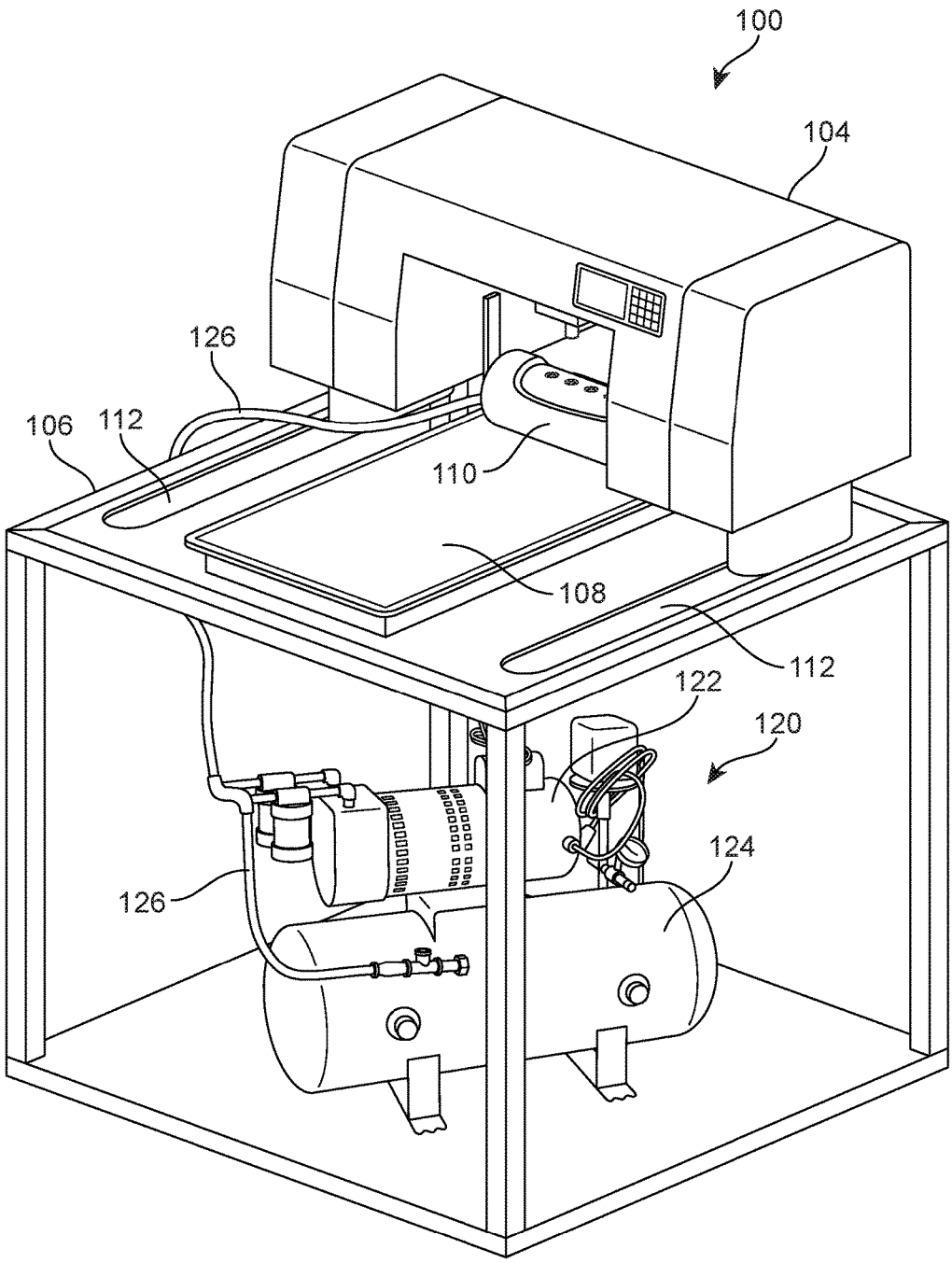
FIG. 1 is a schematic view of an exemplary embodiment of a customization system for an article.

FIG. 1 is a schematic view of an embodiment of customization system 100. In some embodiments, customization system 100 may be intended for use with various kinds of articles including equipment, apparel and/or footwear. In particular, customization system 100 may include various kinds of provisions for applying graphics, or any type of design or image, to equipment, apparel and/or footwear. Moreover, the process of applying graphics may occur after an article has been manufactured. For example, graphics may be applied to an article of equipment after the article has been manufactured. In other cases, graphics may be applied to an article, or one or more components of an article, prior to, and/or during, manufacture. For example, graphics may be applied to a portion of an article prior to being assembled into a finished article.

The term "graphic" as used throughout this detailed description and in the claims refers to any visual design elements including, but not limited to: photos, logos, text, illustrations, lines, shapes, images of various kinds as well as any combinations of these elements. Moreover, the term graphic is not intended to be limiting and could incorporate any number of contiguous or non-contiguous visual features. For example, in one embodiment, a graphic may comprise a logo that is applied to a small region of an article. In another embodiment, a graphic may comprise a large region of color that is applied over one or more regions of an article.

For clarity, the following detailed description discusses an exemplary embodiment, in which customization system 100 is used to apply graphics to an article of equipment that is to be worn. In this case, the article of equipment, or simply article, may take the form of a piece of sports equipment, such as a shin guard. However, it should be noted that the other embodiments could be used with any other kinds of articles of equipment to be worn, including, but not limited to: shin guards, knee pads, elbow pads, shoulder pads, as well as any other type of protective equipment. While FIG. 1 shows a single article, it will be understood that customization system 100 could be used to apply graphics to two or more articles.

Customization system 100 need not be limited to use with articles of equipment and the principles taught throughout this detailed description may be applied to additional articles as well. Generally, these principles could be applied to any article that may be worn. In some embodiments, the article may include one or more articulated portions that are configured to move. In other cases, the article may be configured to conform to portions of a wearer in a three-dimensional manner. Examples of articles that are configured to be worn include, but are not limited to: footwear, gloves, shirts, pants, socks, scarves, hats, jackets, protective equipment such as shin guards and helmets, as well as other articles. Additionally, in some embodiments, the article could be another type of article that is not configured to be worn, including, but not limited to: balls, bags, purses, backpacks, as well as other articles that may not be worn.

Customization system 100 may comprise various provisions that are useful in applying a graphic directly to an article. In some embodiments, customization system 100 may include printing system 104. Printing system 104 may comprise one or more individual printers. Although a single printer is illustrated in FIG. 1, other embodiments could incorporate two or more printers that may be networked together.

Printing system 104 may utilize various types of printing techniques. These may include, but are not limited to: toner-based printing, liquid inkjet printing, solid ink printing, dye-sublimation printing, inkless printing (including thermal printing and UV printing) as well as any other methods of printing. In some cases, printing system 104 may make use of a combination of two or more different printing techniques. The type of printing technique used may vary according to factors including, but not limited to: material of the target article, size and/or geometry of the target article, desired properties of the printed image (such as durability, color, ink density, etc.) as well as printing speed, printing costs and maintenance requirements.

In one embodiment, printing system 104 may utilize an inkjet printer in which ink droplets may be sprayed onto a substrate, such as the outer surface of an article of equipment. Using an inkjet printer allows for easy variation in color and ink density. This arrangement also allows for some separation between the printer head and the target object, which can facilitate printing directly to objects with some curvature and/or surface texture.

In some embodiments, customization system 100 may include additional components for mounting various portions of customization system 100. In an exemplary embodiment, customization system 100 may include a base portion 106. Base portion 106 may comprise a substantially flat surface for mounting one or more components of customization system 100. In an exemplary embodiment, printing system 104 may be disposed on a top side of base portion 106. In some embodiments, base portion 106 may include a stationary platform 108 that comprises a surface for receiving one or more articles. In an exemplary embodiment, stationary platform 108 may be configured to raise an object or an article above the surface of base portion 106. In some cases, stationary platform 108 may be fixed approximately in place on base portion 106. In other cases, stationary platform 108 may be instead be replaced by a movable platform that is configured to move relative to base portion 106. For example, a movable platform may be provided with a tracked or wheeled arrangement as is known in the art to provide movement relative to base portion 106.

In some embodiments, customization system 100 may include a printing system 104 that is configured to move to various positions. In an exemplary embodiment, printing system 104 may be mounted to tracks 112 of base portion 106. In some cases, printing system 104 is mounted in a movable manner to base portion 106, so that printing system 104 may slide or travel along tracks 112. This allows printing system 104 to move between various positions along base portion 106 in the direction of tracks 112 and relative to stationary platform 108. In other cases, printing system 104 may be configured to be stationary on base portion 106 and a movable platform, as discussed above, may be used to move an object or article relative to printing system 104. In still other cases, printing system 104 and a movable platform may be used in combination with one another.

In some embodiments, customization system 100 may be configured to print onto articles of equipment, including, but not limited, to various types of sports equipment. In an exemplary embodiment, customization system 100 may be configured to print onto articles of equipment that have a cylindrical, circular, round, or generally curved configuration including, but not limited to: shin guards, knee pads, elbow pads, shoulder pads, as well as any other type of protective equipment, including individual components of equipment.

In contrast to flat articles, articles of equipment may pose challenges for holding in place to present a surface for printing. Typically, an article of equipment may be worn on a portion of a wearer's body that corresponds to the curvature and shape of the article. Accordingly, in an exemplary embodiment, customization system 100 may be provided with an apparatus for holding an article to provide a surface for printing. In one embodiment, the apparatus for holding the article may be configured as a cylinder 110.

In some embodiments, cylinder 110 may be provided with customization system 100 to hold an article of equipment in a position to allow the exterior surface of the article to be printed. In this configuration, printing system 104 may have a surface for printing onto the article disposed on cylinder 110.

In some embodiments, customization system 100 may be provided with an apparatus configured to circumferentially rotate cylinder 110. In an exemplary embodiment, customization system 100 may include an actuator that is configured to rotate cylinder 110. In one embodiment, an actuator may include a motor that turns a gear or chain drive to rotate cylinder 110. In other embodiments, a different arrangement may be provided to rotate cylinder 110. For example, in some cases, cylinder 110 may be rotated using a rack and pinion arrangement to translate the linear motion of printing system 104 and/or a movable platform into rotational motion of cylinder 110. In still other cases, other arrangements may be used to impart rotational motion to cylinder 110. In addition, various other devices may be used as is known in the art to rotate cylinder 110.

In some embodiments, cylinder 110 may be configured to receive articles of equipment that have a thickness. In some embodiments, cylinder 110 may include one or more recesses in the outer surface of cylinder 110 to accommodate the thickness of an article. In some cases, articles of equipment disposed on cylinder 110 may have a tendency to move when cylinder 110 is rotated. Accordingly, cylinder 110 may include provisions to securely hold an article within the recesses in cylinder 110.

In exemplary embodiment, a vacuum system 120 may be used to assist with holding an article within the recesses provided in cylinder 110. Vacuum system 120 may include a vacuum pump 122 that is configured to generate a partial vacuum by evacuating air from a container. In this embodiment, a vacuum canister 124 may be in fluid communication with vacuum pump 122. Vacuum canister 124 may serve as the container from which vacuum pump 122 evacuates air to generate a partial vacuum. In this case, a partial vacuum may be a quantity of gas that is at a lower pressure than the ambient pressure outside of vacuum canister 124. Vacuum system 120 may include additional components that are configured to supply power and control operation of vacuum pump 122 and vacuum canister 124.

In an exemplary embodiment, vacuum system 120 may also include a fluid line 126 that is in fluid communication with one or more of vacuum pump 122, vacuum canister 124, and cylinder 110. With this arrangement, fluid line 126 permits a partial vacuum to be drawn within cylinder 110 to assist with holding an article in place within the recesses on cylinder 110. In addition, vacuum system 120 may include other components that are known to be associated with a vacuum system, including various valves, ports, and connections that open and close fluid line 126 to apply and/or remove the partial vacuum from cylinder 110.

Figure 2:
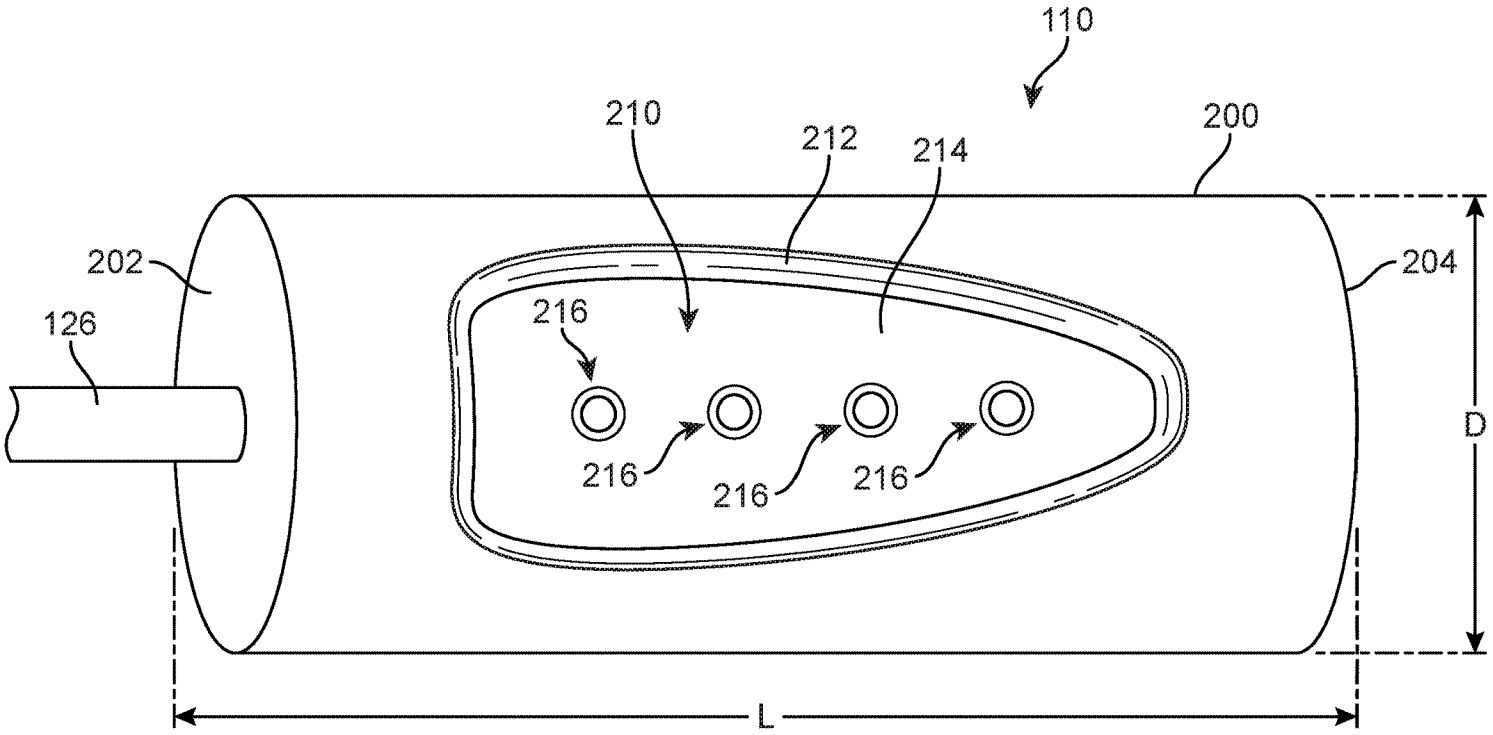
FIG. 2 is an isometric view of an exemplary embodiment of a cylinder for holding articles for use with a customization system.

Referring now to FIG. 2, an exemplary embodiment of cylinder 110 including one or more recesses in the outer surface of cylinder 110 to accommodate an article is illustrated. In an exemplary embodiment, cylinder 110 may be a right circular cylinder associated with a length L along a longitudinal direction of cylinder 110 and a diameter D between opposing points along a circular cross-section of cylinder 110. In this embodiment, cylinder 110 has an outer surface 200 disposed over the exterior of cylinder 110. The surface area of outer surface 200 of cylinder 110 may be determined from a known geometric formula for determining the surface area of a right circular cylinder ($A=2\pi rh$). In this embodiment, the surface area of cylinder 110 is equal to $D\pi L$.

In other embodiments, different cylinders may be provided with different dimensions, including a larger or smaller diameter and/or a larger or smaller longitudinal length L, than cylinder 110. In some embodiments, various cylinders may be provided that are sized and dimensioned so as to support different articles of equipment. For example, a cylinder having a larger diameter and/or a larger length that may be provided for supporting a larger article of protective equipment for printing. In another example, a cylinder having a smaller diameter and/or a smaller length that may be provided for supporting a smaller article of equipment for printing. In another example, a cylinder may have sufficient length so that two articles may be positioned adjacent each other length-wise along the cylinder for simultaneous printing. It should be understood that a cylinder of any diameter and/or length may be provided to fit a specific article for printing.

In some embodiments, cylinder 110 may be described as having a first end 202 and a second end 204 disposed opposite first end 202. First end 202 and second end 204 may be used for purposes of reference to describe the relative location of an article disposed on cylinder 110. In an exemplary embodiment, first end 202 and second end 204 of cylinder 110 may be closed so as to provide an airtight interior within the inside of cylinder 110. In one embodiment, fluid line 126 may be disposed through first end 202 to place the interior of cylinder 110 in fluid communication with vacuum system 120. With this arrangement, a partial vacuum may be applied within the interior of cylinder 110 to assist with holding an article, as described in more detail below.

In an exemplary embodiment, cylinder 110 may be provided with one or more recesses in outer surface 200, including a recess 210. Recess 210 may be configured to accommodate and correspond to an article of equipment to be held in place on cylinder 110. In an exemplary embodiment, recess 210 may be configured to have a shape and size that corresponds to the shape and size of the article to be held in place on cylinder 110. Recess 210 also may be configured to have a depth that is approximately equal to the thickness of the article that is to be held in place on cylinder 110. In other embodiments, the size, shape, and/or depth of recess 210 may be varied according to the article to be held on cylinder 110. In other embodiments, the size, shape, and/or depth of recess 210 may be configured to be a universal size so that many different sizes and shapes of articles may be accommodated by a single recess 210. For example, recess 210 may have the shape of a quadrilateral, where the size of the quadrilateral may accommodate the largest adult male-sized article and any smaller articles. In another example, a specific ergonomic shape of an article, such as a shin guard, may be accommodated by the size of the recess, where a gap is positioned between the edges of the recess and the edges of the article. The size of the gap may differ for different shapes and sizes of different articles.

In some embodiments, recess 210 may be configured with an optional gasket 212 disposed over at least a portion of recess 210. Gasket 212 may be made of a flexible material that is configured to provide an airtight seal between an article and recess 210 so as to hold an article in place on cylinder 110. Suitable materials for gasket 212 may include, but are not limited to: rubber, silicone, or any other flexible materials. In some cases, gasket 212 may extend around a perimeter of recess 210 between a bottom surface 214 of recess 210 and outer surface 200 of cylinder 110. In other cases, gasket 212 may extend around the perimeter of recess and over bottom surface 214. In the embodiments where the recess is sized and shaped to correspond closely with a specific size and/or shape of article, gasket 212 may extend only a short distance from the edge of the recess into the interior space of the recess.

In the embodiments where recess 210 is sized and shaped to accommodate more than one size and/or shape of article, gasket 212 may extend a large distance from the edge of the recess into the interior space of the recess, or even cover the entirety of bottom surface 214. In these embodiments, several interchangeable gaskets of different sizes may be provided to accommodate different articles.

In the embodiments where no gasket is provided, the article itself may be made of a material having sufficient ability to deform to form the seal when the vacuum is pulled. For example, the article may include elastomeric materials such as rubber, silicone, foam, and/or plastics.

In an exemplary embodiment, one or more ports 216 may be disposed on bottom surface 214 of recess 210 to permit the interior of cylinder 110 and/or fluid line 126 to be in fluid communication with recess 210. With this arrangement, ports 216 may allow the negative pressure from the interior of cylinder 110 provided by vacuum system 120 via fluid line 126 to hold an article disposed within recess 210 in place on cylinder 110. In this embodiment, a plurality of ports 216 are disposed along bottom surface 214 at evenly-spaced intervals. In other embodiments, a larger or smaller number of ports 216 may be provided along bottom surface 214 of recess 210. In addition, the spacing and location of ports 216 may be varied to provide targeted areas of greater vacuum pressure to an article disposed within recess 210. For example, in some cases, a portion of an article disposed within recess 210 may be heavier than other portions of the article. In this circumstance, a larger number of ports 216 may be disposed at a location corresponding to the heaver portion of the article when disposed in recess 210 so as to provide additional vacuum pressure to assist with holding the article in place on cylinder 110.

In different embodiments, the recess in outer surface 200 of cylinder 110, including recess 210, may be formed using different processes. In an exemplary embodiment, a CNC machine or similar apparatus may be used to cut or remove a portion of cylinder 110 to form the recess at the desired location, including the location of recess 210. In other embodiments, a recess in outer surface 200 of cylinder 110 may be formed using other methods, including, but not limited to molding or casting techniques.

Figure 3:
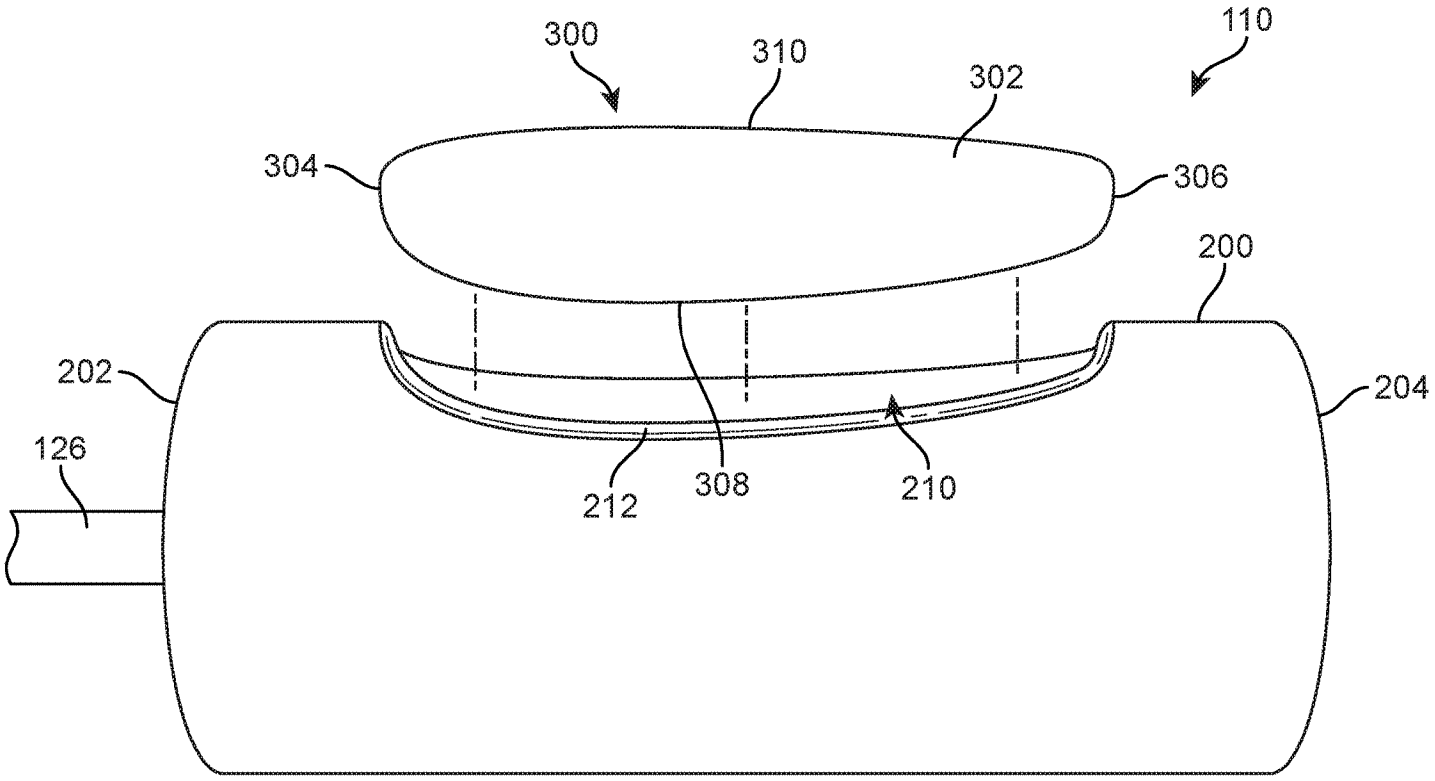
FIG. 3 is an exploded view of an exemplary embodiment of a cylinder for holding articles.

Referring now to FIG. 3, an exploded view of an exemplary embodiment of cylinder 110 for holding articles is illustrated. In this embodiment, cylinder 110 is configured to hold an article of equipment in the form of a shin guard 300. In other embodiments, various other articles may be held using cylinder 110 or a cylinder specifically configured for a particular article, including any of the articles described above.

In this embodiment, shin guard 300 may be configured to cover a portion of a leg of a wearer. In other embodiments, shin guard 300 may be any type of protective equipment. In an exemplary embodiment, shin guard 300 may have an exterior surface 302. Exterior surface 302 may be configured to face outwards away from the leg of wearer when shin guard 300 is worn. Shin guard 300 may include a top end 304 and a bottom end 306. Top end 304 may be configured to be oriented below a knee of the wearer when shin guard 300 is worn, whereas bottom end may be configured to be oriented above a foot of the wearer when shin guard 300 is worn. Shin guard 300 may further include a first side 308 and a second side 310. First side 308 and second side 310 may extend along the length of shin guard 300 on opposite sides between top end 304 and bottom end 306.

As shown in FIG. 3, in some embodiments, recess 210 in outer surface 200 of cylinder 110 may be configured to receive an article, including shin guard 300. The size and dimensions of recess 210 are configured to correspond to the size and dimensions of shin guard 300. In an exemplary embodiment, recess 210 is provided with gasket 212 that is configured to contact at least the perimeter of shin guard 300, including along a portion of top end 304, first side 308, bottom end 306, and second side 310. In addition, shin guard 300 may be placed into recess 210 such that exterior surface 302 of shin guard 300 is oriented facing away from cylinder 110. With this arrangement, exterior surface 302 of shin guard 300 may be prepared for printing thereupon.

Figure 4:
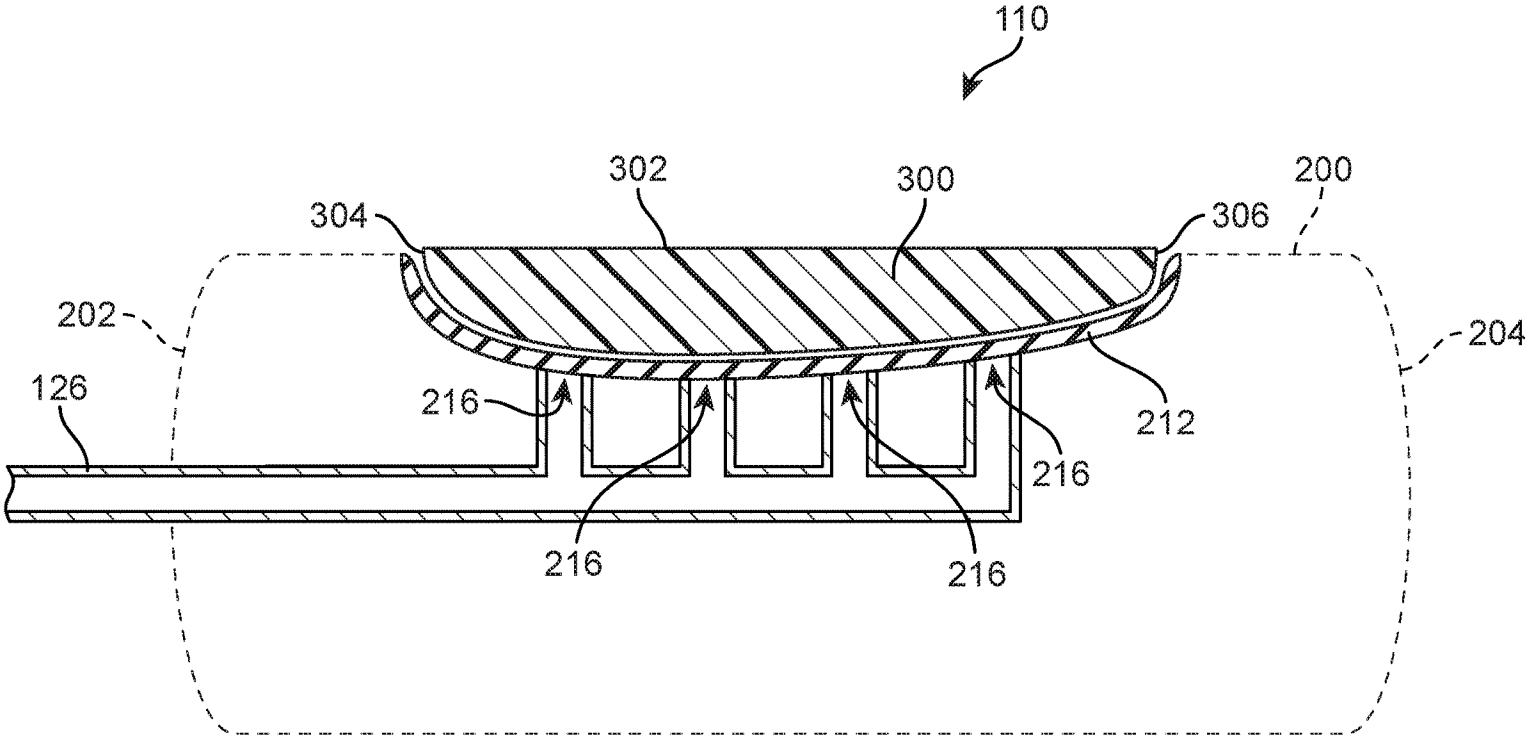
FIG. 4 is a cross-sectional view of an exemplary embodiment of an article disposed on a cylinder.
Figure 5:
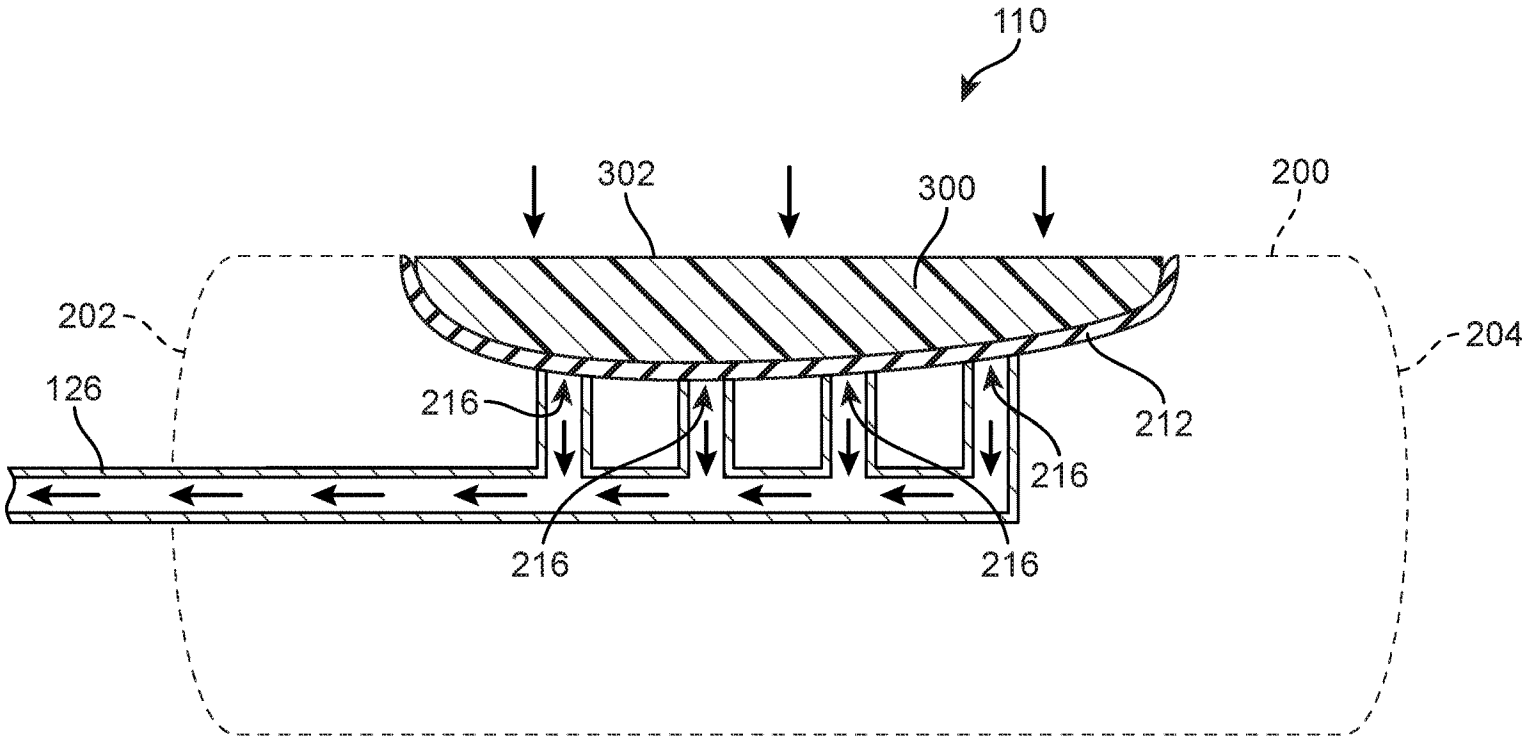
FIG. 5 is a schematic view of an exemplary embodiment of a vacuum being applied to a cylinder for holding an article for printing.

FIGS. 4 and 5 illustrate an exemplary embodiment of an article disposed within recess 210 on cylinder 110 and being held in place using a partial vacuum applied to cylinder 110. Referring to FIG. 4, in this embodiment, shin guard 300 is disposed within recess 210 on cylinder 110. In one embodiment, gasket 212 may be provided within recess 210 and assist with providing an airtight seal between shin guard 300 and cylinder 110. In this embodiment, cylinder 110 is shown in phantom to illustrate the interior of cylinder 110, including fluid line 126 and ports 216. As shown in FIG. 4, ports 216 allow fluid communication between fluid line 126 and recess 210. In this embodiment, ports 216 include four ports disposed below shin guard 300. In other embodiments, a larger or smaller number of ports may be provided. In addition, in other embodiments, first end 202 and second end 204 of cylinder 110 may be closed to create a sealed interior within cylinder 110 and ports 216 may be in fluid communication with the interior of cylinder 110, which may be supplied with a partial vacuum from fluid line 126.

Referring now to FIG. 5, vacuum system 120 may be used to apply a partial vacuum to shin guard 300 via fluid line 126 and ports 216. In this embodiment, the negative pressure associated with partial vacuum generated by vacuum system 120 causes shin guard 300 to be pulled into recess 210 against gasket 212 to form an airtight seal. This negative pressure caused by the partial vacuum serves to hold shin guard 300 in place on cylinder 110. In an exemplary embodiment, the vacuum pressure provided via fluid line 126 and ports 216 is sufficient to hold shin guard 300 in place within recess 210 while cylinder 110 rotates during the printing process.

In some embodiments, the partial vacuum applied to shin guard 300 via fluid line 126 and ports 216 may also serve to cause exterior surface 302 of shin guard 300 to be approximately even with the outer surface 200 of cylinder. With this arrangement, shin guard 300 may present a substantially uniform surface for printing using printing system 104, described below.

Figure 6:
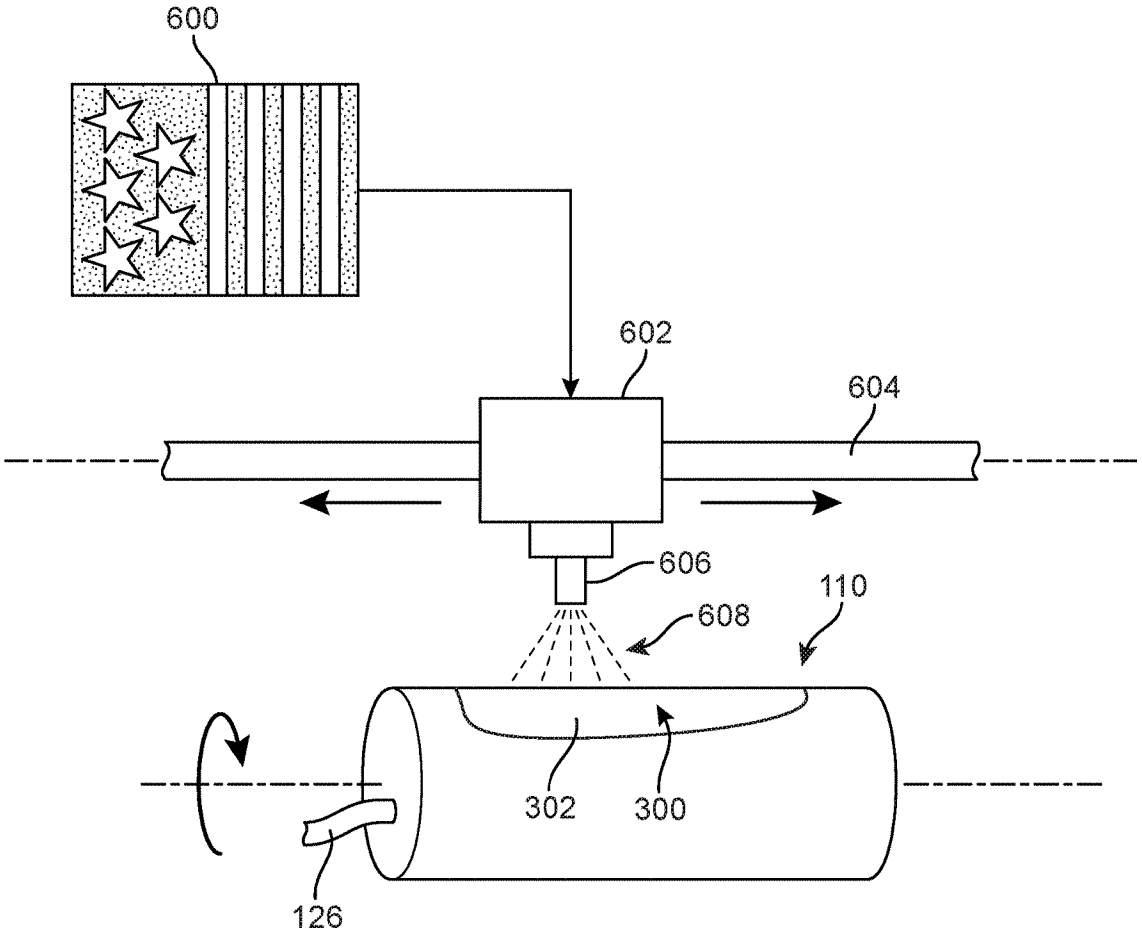
FIG. 6 is a representational view of an exemplary embodiment of using a customization system including a cylinder for holding an article for printing.

Referring now to FIG. 6, a representational view of shin guard 300 being held within recess 210 on cylinder 110 during printing is illustrated. In this embodiment, shin guard 300 is disposed with recess 210 of cylinder 110. In an exemplary embodiment, negative pressure provided from a partial vacuum generated by vacuum system 120 is used to hold shin guard 300 in place on cylinder 110 via fluid line 126. With this arrangement, exterior surface 302 of shin guard 300 is configured for printing thereupon.

In some embodiments, customization system 100 may be used for printing a graphic 600 onto shin guard 300. Graphic 600 could be stored using a computer system in communication with customization system 100 or may be retrieved from another source. In other embodiments, graphic 600 may be designed using software associated with customization system 100. In one embodiment, graphic 600 may be a custom designed image that may be applied to an article for the purposes of customizing the article to suit a particular customer or user. In some embodiments, customization system 100 may be used to print graphic 600 onto an article of equipment. In this embodiment, shin guard 300 has been mounted onto cylinder 110 for printing graphic 600 thereupon.

As described above, in some embodiments, customization system 100 may include printing system 104 having a printer 602. In an exemplary embodiment, printer 602 may be mounted upon one or more rails 604 to allow printer 602 to move or translate along an x-axis aligned with the longitudinal direction of shin guard 300 disposed on cylinder 110. In cases where printer 602 includes an inkjet printer, one or more printheads, including a printhead 606, may be configured to deposit ink droplets 608 onto a substrate. In this embodiment, printhead 606 is configured to spray ink droplets 608 onto exterior surface 302 of shin guard 300. As described above, shin guard 300 held within recess 210 of cylinder 110 may be configured to circumferentially rotate during printing so as to rotate shin guard 300 for printing.

In an exemplary embodiment, rotation of shin guard 300 and/or movement of printer 602 along rails 604 may allow graphic 600 to be printed onto substantially all of exterior surface 302 of shin guard 300. In one embodiment, graphic 600 may be printed over exterior surface 302 of shin guard 300 through approximately 180 degrees of rotation. In some cases, graphic 600 may be printed over exterior surface 302 of shin guard 300 through less than 180 degrees of rotation depending on the size and shape of shin guard 300. With this arrangement, graphic 600 may be printed across the exterior surface of an article disposed within a recess in cylinder 110. In other embodiments, more or less of an article may be printed upon, including only a portion of exterior surface 302 of shin guard 300.

In addition, in other embodiments, multiple graphics of varying sizes, colors, and/or configurations may be printed on substantially all of exterior surface 302 of shin guard 300 or on one or more portions of shin guard 300. In addition, in the present embodiment, printhead 606 may be located a fixed, predetermined distance from exterior surface 302 of shin guard 300. In other embodiments, however, printhead 606 may be configured to move in a vertical direction relative to exterior surface 302.

In some embodiments, the layout of graphic 600 may be processed by a computer or processor into a series of commands for moving printer 602 along rails 604 and/or rotating shin guard 300 disposed on cylinder 110 to deposit ink droplets 608 onto the appropriate locations on exterior surface 302 to generate graphic 600 onto shin guard 300. In an exemplary embodiment, a suitable computer system that may be used for preparing graphic 600 or other graphics for printing is disclosed in co-pending and commonly owned U.S. Patent Application Ser. No. 61/808,543 to Miller et al., entitled "Image Correction with 3D Printing" and filed on Apr. 4, 2013.

Figure 7:
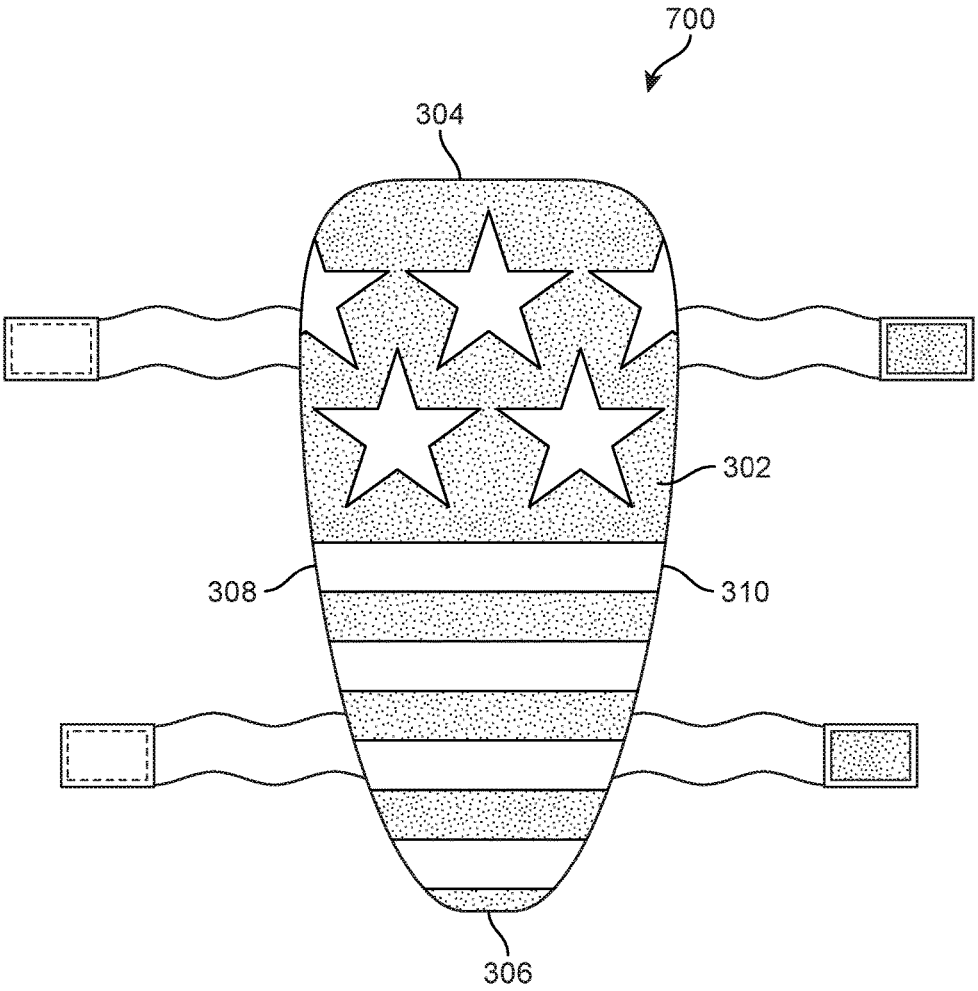
FIG. 7 is a schematic view of an exemplary embodiment of an article having a graphic printed using a customization system including a cylinder.

FIG. 7 illustrates an exemplary embodiment of a printed article 700 that has been printed using the system and process described herein. As shown in FIG. 7, printed article 700 is shin guard 300 that has had graphic 600 printed upon exterior surface 302 using cylinder 110. After printing graphic 600 onto shin guard 300 using printing system 104, described above, shin guard 300 may be removed from cylinder 110 to result in printed article 700. In some embodiments, printed article 700 may be completed by adding additional accessories or components that assist with wearing the article on a user.

In this embodiment, graphic 600 is printed across substantially all of exterior surface 302. As noted above, in other embodiments, less than the entirety of exterior surface 302 may be printed upon. By using cylinder 110 having a recess to accommodate shin guard 300 and vacuum system 120 to generate a partial vacuum to hold shin guard 300 in place, graphic 600 may be printed across exterior surface 302 of printed article 700.

It should be understood that while in the previous embodiments, an exemplary article of equipment in the form of a single shin guard has been illustrated, the principles described herein may be similarly applied to a second identical article to provide a pair of articles, or other similar articles of equipment that are worn in pairs or with multiple component parts.

Figure 8:
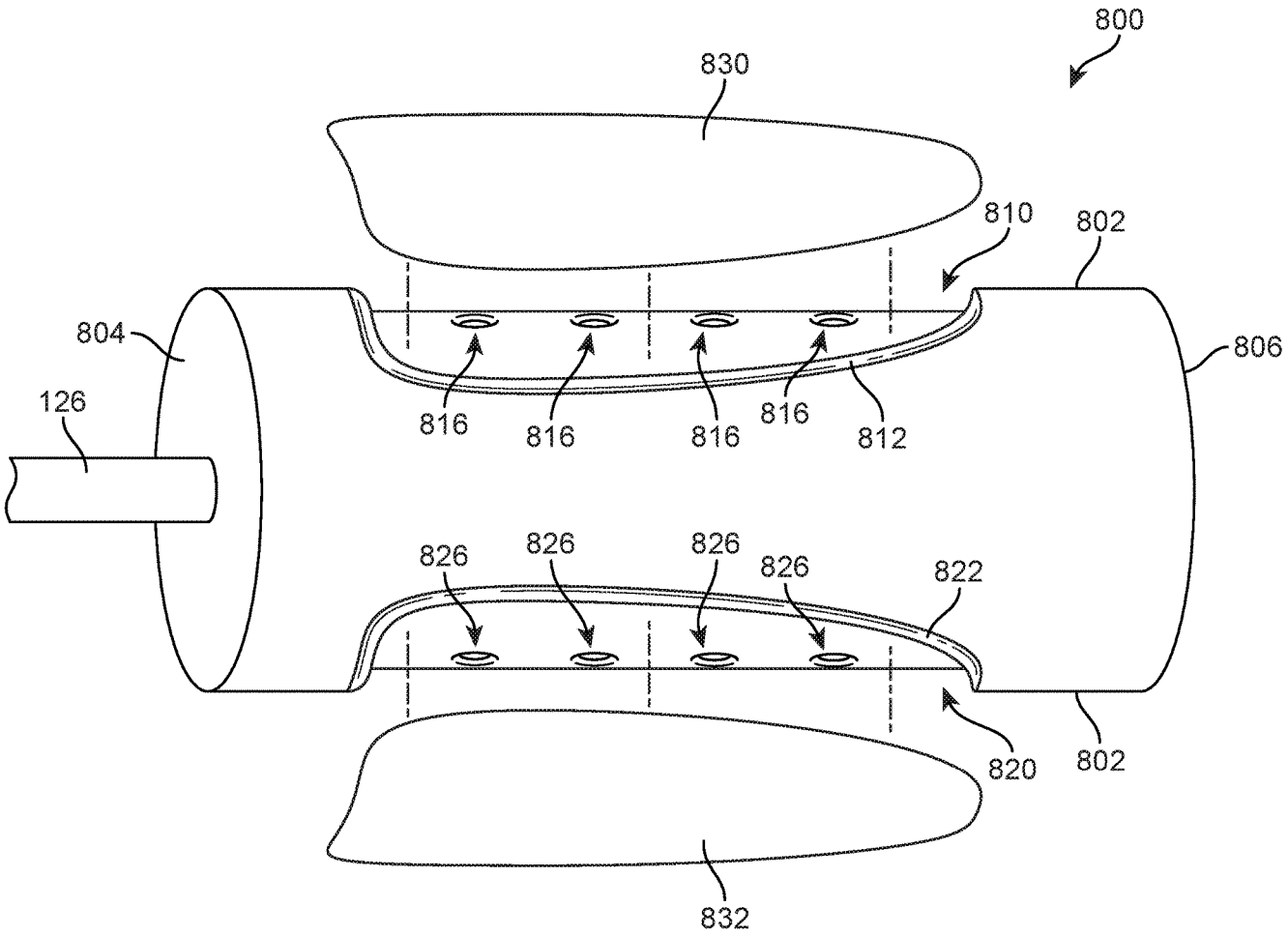
FIG. 8 is an alternate embodiment of a cylinder for holding a pair of articles for printing.

In some embodiments, a cylinder may be provided that is configured to hold a pair of articles to allow printing of a complete pair of articles during the same printing process. Referring now to FIG. 8, an alternate embodiment of a cylinder 800 is illustrated. In an exemplary embodiment, cylinder 800 may be substantially similar to cylinder 110, but provided with two recesses in an exterior surface 802 to accommodate two substantially similar articles of equipment forming a pair of articles. Other components of cylinder 800 may be substantially similar to components of cylinder 110, including fluid line 126. In addition, cylinder 800 may include a first end 804 and a second end 806 that are substantially similar to first end 202 and second end 204, described above.

In this embodiment, cylinder 800 includes a first recess 810 and a second recess 820. In an exemplary embodiment, first recess 810 and second recess 820 may be disposed on opposite sides of cylinder 800. First recess 810 and second recess 820 may be substantially similar to recess 210, described above. In an exemplary embodiment, first recess 810 may include first gasket 812 disposed around at least a perimeter of first recess 810. First gasket 812 may be substantially similar to gasket 212, described above. In some cases, first gasket 812 may additionally extend over the bottom surface of first recess 810. In addition, first recess 810 may include a plurality of ports 816 disposed in the bottom surface that are in fluid communication with fluid line 126. Ports 816 may be substantially similar to ports 216, described above, and may allow negative pressure from the interior of cylinder 800 provided by vacuum system 120 via fluid line 126 to hold an article disposed within first recess 810 in place on cylinder 800.

Similarly, in an exemplary embodiment, second recess 820 may include second gasket 822 disposed around at least a perimeter of second recess 820. Second gasket 822 may be substantially similar to gasket 212, described above. In some cases, second gasket 822 may additionally extend over the bottom surface of second recess 820. In addition, second recess 820 may include a plurality of ports 826 disposed in the bottom surface that are in fluid communication with fluid line 126. Ports 826 may be substantially similar to ports 216, described above, and may allow negative pressure from the interior of cylinder 800 provided by vacuum system 120 via fluid line 126 to hold an article disposed within second recess 820 in place on cylinder 800.

In some embodiments, cylinder 800 may be configured to receive a pair of articles, including a first article 830 and a second article 832. In an exemplary embodiment, first article 830 and second article 832 may be a pair of shin guards that are to be worn on the right and left legs of a wearer. In this embodiment, first recess 810 is configured to receive first article 830 and second recess 820 is configured to receive second article 832. As noted above with reference to recess 210, first recess 810 and/or second recess 820 may have a corresponding shape as first article 830 and/or second article 832 and may be sized and dimensioned to correspond with the size and dimensions of first article 830 and/or second article 832.

In an exemplary embodiment, vacuum system 120 may be used to apply a partial vacuum to first article 830 and/or second article 832 via fluid line 126 and ports 816 and/or ports 826. The negative pressure associated with the partial vacuum generated by vacuum system 120 causes first article 830 and/or second article 832 to be pulled into first recess 810 and/or second recess 820 against first gasket 812 and/or second gasket 822 to form an airtight seal. This negative pressure caused by the partial vacuum serves to hold first article 830 and/or second article 832 in place on cylinder 800 while cylinder 800 rotates during the printing process.

With this arrangement, a graphic may be applied to first article 830 and/or second article 832 during the same printing process to produce a finished pair of articles. In other embodiments, cylinders having additional recesses may be provided to accommodate additional articles so that multiple articles may be printed during the same printing process.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims. Further, any element of any embodiment may be used in any other embodiment or substituted for another element of another embodiment unless specifically restricted.

What is claimed is:

1. A cylinder for holding an article of equipment to assist with printing a graphic onto the article, comprising:

an outer surface of the cylinder, the outer surface having a length along a longitudinal axis of the cylinder and the cylinder having a diameter;

a recess disposed in the outer surface of the cylinder, the recess sized and dimensioned so as to correspond to the article of equipment and having at least a portion that is convex;

a fluid line for receiving a partial vacuum;

a plurality of ports disposed along a bottom surface of the recess;

wherein the fluid line and the plurality of ports are in fluid communication; and wherein the cylinder is configured to rotate to expose an exterior surface of the article to a printer for printing.

2. The cylinder according to claim 1, wherein the article is disposed within the recess in the outer surface of the cylinder.

3. The cylinder according to claim 2, wherein the plurality of ports are disposed beneath the article when the article is within the recess; and wherein negative pressure generated by the partial vacuum received from the fluid line and through the plurality of ports is configured to hold the article within the recess while the cylinder rotates.

4. The cylinder according to claim 2, wherein a gasket is disposed at least along a perimeter of the recess between the recess and the article when the article is disposed within the recess.

5. The cylinder according to claim 4, wherein the gasket is disposed over the bottom surface of the recess.

6. The cylinder according to claim 4, wherein the gasket forms an airtight seal with the article when the negative pressure is applied to the article from the partial vacuum received through the fluid line and the plurality of ports.

7. The cylinder according to claim 1, wherein the article is a shin guard.

8. A cylinder for holding an article of equipment to assist with printing a graphic onto the article, comprising:

a diameter associated with the cylinder and a length along a longitudinal axis of the cylinder;

an outer surface disposed over the length of the cylinder;

the outer surface including at least one recess, the at least one recess being elongated along the longitudinal axis and extending to a bottom surface at a depth below the outer surface;

the bottom surface of the at least one recess including a plurality of ports extending along a length of the recess, the plurality of ports being in fluid communication with an interior of the cylinder;

wherein the article is configured to be disposed within the at least one recess in the outer surface of the cylinder;

wherein a partial vacuum applied to the article through the plurality of ports is configured to hold the article within the recess while the cylinder rotates, and wherein at least a portion of the recess has radial curvature relative to the longitudinal axis.

9. The cylinder according to claim 8, wherein the depth of the at least one recess corresponds to a thickness of the article.

10. The cylinder according to claim 9, wherein an exterior surface of the article is approximately even with the outer surface of the cylinder when the article is disposed within the at least one recess.

11. The cylinder according to claim 8, wherein the at least one recess comprises at least two recesses in the outer surface of the cylinder.

12. The cylinder according to claim 11, wherein a pair of articles of equipment are configured to be disposed within the at least two recesses in the outer surface of the cylinder.

13. The cylinder according to claim 8, further comprising a gasket disposed along at least a perimeter of the at least one recess.

* * * * *